United States Patent [19]

Schott

[11] 4,444,092

[45] Apr. 24, 1984

[54] HYDRAULIC PUMP

[75] Inventor: Marcel Schott, Fontenay-le-Fluer, France

[73] Assignee: Messier-Hispano-Bugatli (SA), Montrouge, France

[21] Appl. No.: 364,700

[22] Filed: Apr. 2, 1982

[30] Foreign Application Priority Data

Apr. 2, 1981 [FR] France ..... 81 06609

[51] Int. Cl.[3] ..... F01B 13/04

[52] U.S. Cl. ..... 91/486; 91/506

[58] Field of Search ..... 91/486, 487, 506, 485

[56] References Cited

U.S. PATENT DOCUMENTS

| | | | |
|---|---|---|---|
| 2,430,764 | 11/1947 | Gabriel | 417/222 |
| 3,079,870 | 3/1963 | Thoma | 91/485 |
| 3,142,262 | 7/1964 | Firth et al. | 91/488 |
| 3,208,395 | 9/1965 | Budzich | 91/505 |
| 3,631,764 | 1/1972 | Lucien | 91/506 |
| 3,728,943 | 4/1973 | Lucien | 91/506 |

*Primary Examiner*—William L. Freeh
*Assistant Examiner*—Paul F. Neils
*Attorney, Agent, or Firm*—Sughrue, Mion, Zinn, Macpeak and Seas

[57] ABSTRACT

This invention relates to hydraulic pumps. The pump includes essentially a casing (1), a barrel (3) capable of rotating on a slide face (2), the barrel comprising a plurality of pistons (16, 17) sliding in a reciprocating manner in cylinders (9, 10) provided in the casing, the pump being characterized essentially by the fact that it comprises structures (59, 54, 50, 52, 53) for sequentially applying the pressure prevailing in the cylinder on a given portion between a bearing block (26) made in the casing (1) and the part of said barrel (3) cooperating with the bearing block (26). The pump finds a particularly advantageous application in the area of those which must rotate at very high speed, for example in aeronautics.

5 Claims, 2 Drawing Figures

HYDRAULIC PUMP

FIELD OF THE INVENTION

The present invention relates to hydraulic pumps and more particularly to those including a barrel rotating in relation to a slide face, the barrel comprising a certain number of pistons sliding in cylinders to perform essentially two functions, namely suction and discharge.

BACKGROUND OF THE INVENTION

Such pumps are already well known, particularly in the aeronautics field in which they allow self-regulated pumping of a control fluid for different hydraulic devices.

More particularly, in such pumps there is a slide face having at least two ports, including a suction port and a discharge port, a barrel rotating against this slide face, a set of pistons sliding in cylinders with a reciprocating motion corresponding to the suction function when the piston rises in the cylinder and to the discharge function when it descends.

This pump moreover comprises drive means to rotate this barrel in relation to the slide face. These means are made up essentially of a rotary shaft coupled to the barrel and pivoting in a fixed recess in relation to the slide face. This recess is made in a casing which also supports the slide face. It is to be noted that this recess can be located either on the periphery of the barrel or in certain cases at its center. In any case, it is necessary that the rotation in relation to the wall of the recess be favored to prevent any jamming because, when such a pump operates, it brings about a resultant of forces of significant magnitute on the axis of rotation.

To accomplish this, the shaft is generally coupled to the recess through an antifriction bearing such as a needle bearing, for example.

This arrangement gives good results but the service life may not be long enough to meet all the application requirements of these pumps, particularly at very high rotating speeds and discharge pressures.

Furthermore, the geometry, determined by considerations relative to overall dimensions and weight, the different hydraulic parameters to be complied with, and noise levels, call for reduced dimensions for the bearing.

It is the object of the present invention to provide a hydraulic pump having structural features giving it a service life long enough to be acceptable in all technical fields and especially in the aeronautical field.

More precisely, the object of the present invention is to provide a hydraulic pump comprising:

a slide face in which are formed two ports, respectively the suction and discharge ports, a casing supporting said slide face, a barrel capable of pivoting, on the one hand around an axis perpendicular to the surface of said slide face in a bearing block integral with said support casing and, on the other hand, against said slide face, said barrel comprising a plurality of hollow cylinders each having an opening leading out onto the side of said barrel sliding on the surface of said slide face to move over said ports, pistons sliding in a sealed manner respectively in each of said cylinders, means for controlling, when a rotation is imparted to said barrel, on the one hand the movement of said pistons away from the opening of the cylinders in which they slide when this opening passes in front of the suction port and, on the other hand, the movement of said pistons toward the opening of said cylinders in which they slide when this opening passes in front of the discharge port, characterized in that it includes means for sequentially supplying the pressure prevailing in said cylinders on the given portion between said bearing block and the part of said barrel cooperating with said bearing block.

Other characteristics and advantages of the present invention will appear from the following description in connection with the illustrative drawings.

DESCRIPTION OF THE PREFERRED EMBODIMENT

Figure 1:
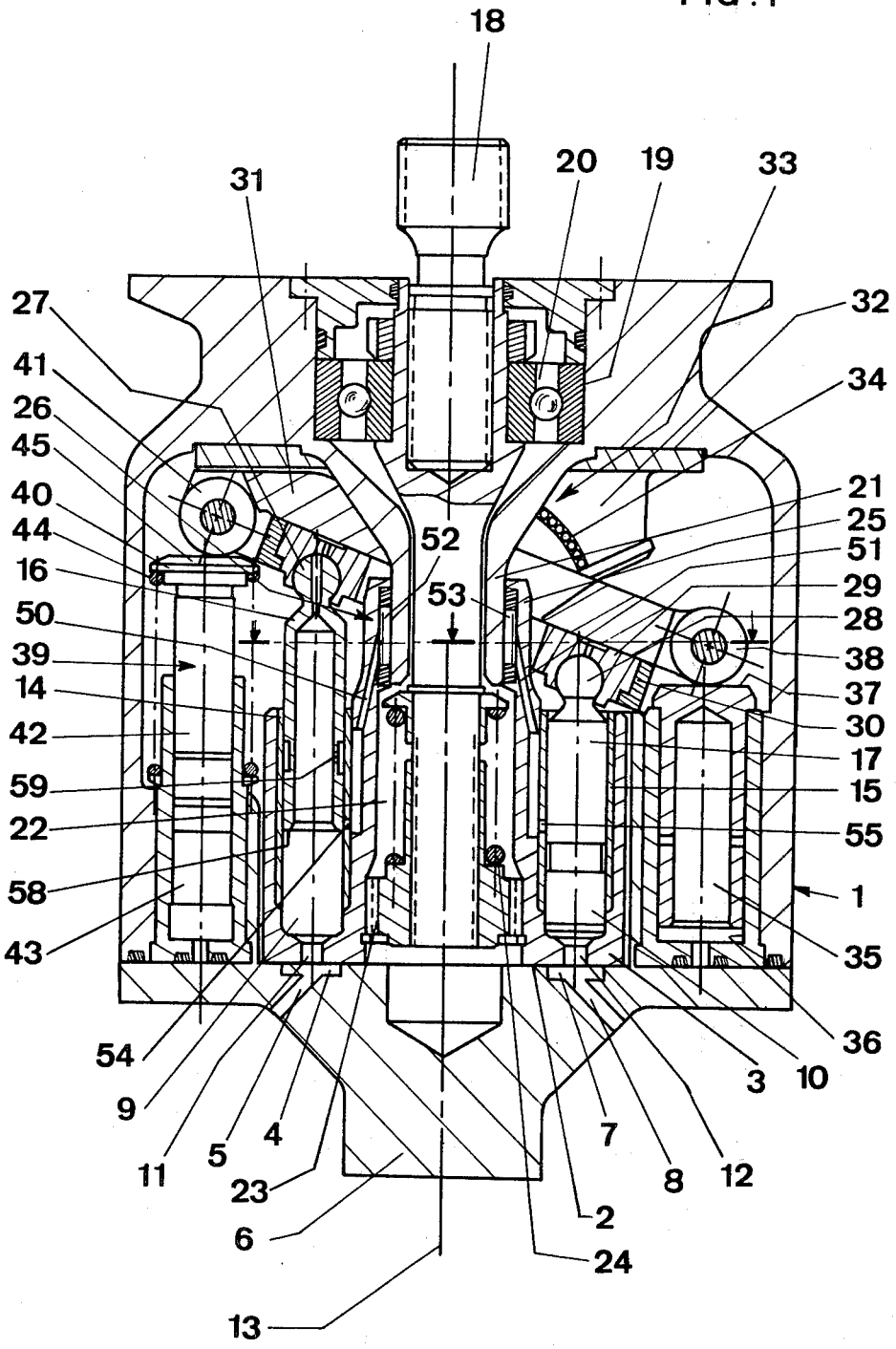
FIG. 1 represents, in longitudinal section, an embodiment of a hydraulic pump according to the invention.

FIG. 1 represents in section an embodiment of a pump comprising a hollow casing 1 defining in one of its interior parts a perfectly smooth slide face 2 on which a barrel 3 can rotate slidably.

In this slide face can be provided at least two ports constituting the fluid inlet and outlet of the pump.

Given the representation, the port 4 supplied by the channel 5 made in the base 6 of the casing 1 constitutes the suction inlet whereas the other port 7 connected to the channel 8 constitutes the discharge outlet.

The barrel 3 consists substantially of a cylindrical annular part in which is provided a plurality of cylindrical bores or recesses, such as the recesses 9 and 10 having respective openings 11 and 12 leading out on the side which is in contact with the slide face 2. These openings are located so that when the barrel is imparted a rotation around an axis 13, as explained below, these openings move opposite the ports 4 and 7.

Advantageously, these cylindrical recesses are lined with a bushing such as the bushings 14 and 15 of an antifriction material so that each recess can receive a piston which slides therein in a sealed manner and especially with minimum friction. Two pistons 16 and 17 appear in FIG. 1.

As indicated previously, the barrel 3 must be imparted a rotation around an axis 13. To accomplish this, the pump includes a drive shaft 18 which, in this embodiment, is placed in the axis of the casing 1 and goes through it in a bearing block 19 comprising a bearing of the ball type 20 for example, an inset ring 21 integral with the casing 1 forming a free interior passage for the drive shaft 18.

This shaft 18 goes into the central hollow part 22 of the barrel 3 to cooperate with the latter through a gear 23.

In this manner, when the shaft 18 is imparted a rotation, it brings about the rotation of the barrel around the axis 13. Advantageously, this shaft consists of a so-called fusible shaft whose advantages are known.

It moreover makes it possible to keep the barrel constantly against the slide face 2, notably by the action of a spring 24.

However, it is quite clear that when the barrel turns at very high speeds, it is necessary to guide it in a bearing. In certain configurations, this guide bearing is located on the periphery of the barrel, but in other cases it is located in the central part, as illustrated more particularly in FIG. 1. This bearing will be explained more thoroughly below. However, very schematically, it includes a shoulder 25 integral with the barrel surrounding externally the inset ring 21 of the casing 1, and means for favoring the sliding of this shoulder 25 on this ring 21, these means being essentially illustrated at 26.

The pump thus includes, as stated previously, a plurality of pistons made up of hollow cylinders whose end is terminated by a spherical head such as the heads 27 and 28 which cooperate with an annular piece forming a pad 29 in the form of a disc capable of rotating slidably on a plate 31, this disc being maintained by a shoulder 30. This plate does not turn around the axis 13 but, by contrast, is maintained against a spherical cradle 32 through a bearing 33, for example of the needle type 34, so that it can tilt between two limits. Control of the tilting of this plate can be carried out by any means. Advantageously, these means which are of a known type are composed essentially of a piston 35 which can be supplied by a fluid under pressure, this piston capable of moving in a cylinder 36 so that its head 37 comes up against an edge 38 of the plate. By thus controlling the position of the piston 35, the edge 38 of the plate is more or less high and determines the inclination of this plate.

The force exerted by this piston 35 on the edge 38 of the plate must be compensated by an opposing force, preferably elastic, either under pressure or compression.

In the illustrated embodiment, this force is exerted by a compensation piston 39 whose head 40 bears on the same side of the plate 31 but on an edge 41 diametrically opposite the edge 38 on which the head 37 of the piston 35 bears. This piston 39 comprises a sliding piece 42 in a recess 43 and a spring 44 exerting a force on a shoulder 45 forming the head 40 of this piece 42.

The inclination variation is of course favored by the needle bearing 33.

The pump just described operates as follows.

The shaft 18 is imparted a rotation by a motor of any type at a fairly high rotating speed.

The channel 4 is connected to a fluid source which is generally oil in the aeronautics field, and the channel 8 to a fluidic load, for example an actuating cylinder or similar device.

Consequently, when the shaft is rotated and the plate has a certain non-zero inclination, the barrel is also driven at a certain rotating speed by the grooves 23 whose value is that of the shaft 18 in most cases.

It is then evident that in the same rotation of the barrel are carried the pistons and the annular pad, the latter remaining retained in the shoulder 30 and by the return disc 29. In this rotation, and more particularly in a complete revolution of the barrel, a piston such as the pistons 16 and 17 goes through a so-called top dead center position and a bottom dead center position. These two positions are illustrated in FIG. 1 respectively by the positions of the two pistons 16 and 17. When these two pistons go respectively from one position to another, they carry out an upward movement and a downward movement in their respective cylinders 9 and 10.

When the piston goes through an upward movement and the openings 11 and 12 move opposite the port 4, the suction of fluid takes place from the source and tends to fill the cylinders 9. When the opening 11 goes beyond the port 4, the pistons begin their downward movement, thereby compressing the fluid in the cylinders. The fluid is then ejected under pressure when the openings 12 move opposite the ejection port 7.

This process is repeated with each revolution of the barrel and for each piston in association with its cylinder.

Finally, it is pointed out that if the inclination of the plate is modified, it is possible to change in particular the flow of the fluid at the outlet of the pump.

As indicated above, the barrel turns very rapidly and the pressures which are produced in these pumps are very high. With this, and in addition with the inclination of the plate, there occurs on the guide bearing 26 a resultant of forces perpendicular to the ring 21 having a relatively constant value for a given pump. In pumps of the prior art, the means making up the bearing block 26 consist of a needle type bearing which deteriorates very rapidly owing to this component combined with that of the speed and the high discharge pressures.

Figure 2:
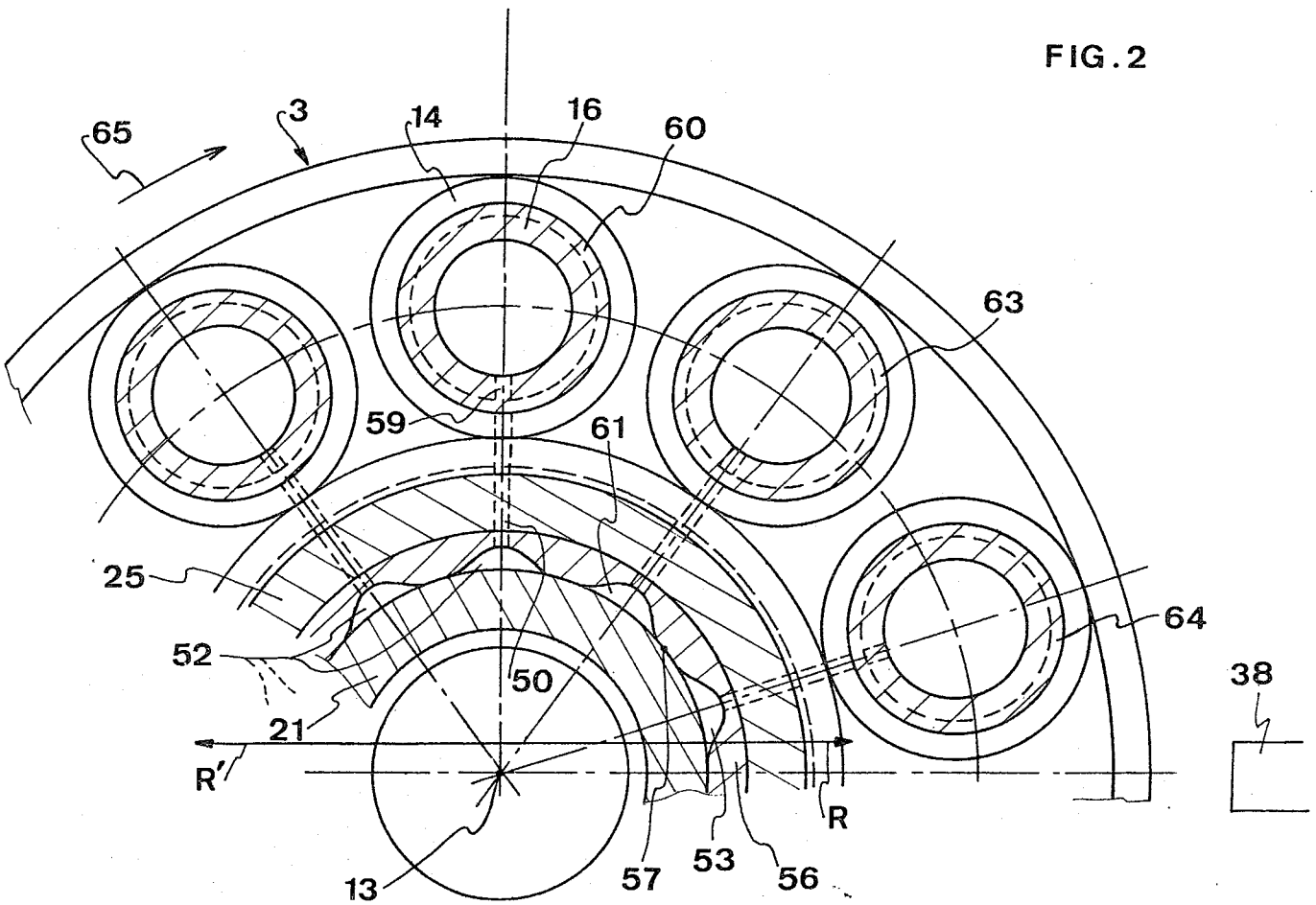
FIG. 2 represents, in a section perpendicular to that of FIG. 1 only a part of the embodiment according to FIG. 1.

To overcome this drawback, the pump is designed for example as illustrated in FIGS. 1 and 2. The means used are described more particularly with reference to FIGS. 1 and 2.

The pump thus includes, in association with each cylinder, a channel 50, 51 made in the barrel connecting a well defined location 54, 55 of the cylinder to a cavity 52, 53 formed between the barrel and the inset ring 21.

These cavities 52, 53 are advantageously made in the thickness of a bushing 56 or a lining of the bore consisting of antifriction material. These cavities have a width determined so that they do not communicate with each other except through a possible space 57 between the bushing 56 and the inset ring 21 or at least so that leaks between two contiguous cavities are sufficiently small so that the possible communication is constituted by a throttle and so that, as will be explained below, when one of the cavities is pressurized by a fluid, this fluid remains under pressure for a sufficiently long time and, especially, does not supply the other cavities too rapidly.

Furthermore, as illustrated in FIG. 1, the pistons consist, as shown on piston 16, of a hollow cylinder closed on one end and open on the other, i.e. on the end which is normally opposite the bottom of the recesses which must pass opposite the ports 4 and 7.

This makes it possible to obtain, at a certain distance from the bottom 58 of this cylinder, an orifice 59 in the wall, this orifice communicating with a groove 60 peripheral to the piston. This groove has a certain thickness and especially a given length.

In fact, as pointed out above, when the pump operates, the pistons have reciprocating movement in their recess between two limit positions. When the piston is at top dead center in its recess, its bottom 58 is very near the orifice 54 but nevertheless covers it completely to close it off.

On the other hand, the distance from the bottom 58 to the edge of the groove 60 is determined so that when the piston moves from top dead center to bottom dead center the entire width of the groove passes in front of the calibrated orifice 54 and may even exceed it. It will of course be necessary to locate the position of this groove so that when the piston is moving downward, i.e. compressing the fluid, the flow which will be sent into the line 50 has a well determined value. Of course, when the piston moves up in its recess, from its bottom dead center position to its top dead center position, the groove 60 moves opposite the orifice 54 again but, in this case, as the piston performs suction, the pressure in its recess is negligible and no pressure is applied in the cavity 52 which is associated with this piston. Finally, as stated earlier, the resultant of the forces exerted on the inset ring 21 when the pump is operating generally has a modulus and a direction which are well determined. Thus, if the positions of the grooves 60 of the orifices 54 are perfectly defined, when the pump operates, one or several cavities, such as the cavity 53, will be supplied by fluid under pressure in a sequential manner until this cavity passes into the region of the point of application of this resultant.

However, since the pump rotates and all the pistons pass in front of the calibrated orifices 54, still for a given position of the barrel in relation to the inset ring, it will always be the cavities which pass opposite the point of application of the resultant of the forces which will be placed under pressure. Consequently, the pressure prevailing in these cavities exerts a set of forces of which the resultant has a point of application coinciding substantially with the one which was defined above, and a modulus substantially equal but in an opposite direction. It is thus apparent that the mechanical friction of the bearing block 26 on the inset ring 21 is almost perfectly cancelled. The bearing block consequently has a much longer service life than those in prior art pumps.

What has been described above functions perfectly. It should however be noted that the numerical design data are difficult to calculate but nevertheless relatively easy to determine by experimentation.

FIG. 2 is an illustration of a pump built by the applicant and in which the applicant has observed that the resultant had a form such as the one shown at R in this figure.

The applicant has designed the pump so that two cavities are supplied under pressure when they occupy the positions shown at 61, 53. With this arrangement, the applicant obtained a resultant R′ with more than 95% compensation, as shown in the figure, giving full satisfaction.

It is found that these two components R and R′ are in opposition and have substantially the same modulus.

Referring to the illustration of the embodiment in FIG. 2, the operation of the pump appears more clearly. In fact, the barrel 3 turns about the axis 13.

For a position of this barrel, the pistons 63, 64 will supply for a given time the two cavities 61, 53 which slide against the ring 21 with a high fluid pressure. This sliding takes place on a circular sector determined (as a function of the width of the groove 60 and the barrel rotating speed) to give rise to the resultant R′ which is almost perfectly in opposition with the resultant R. However, since the barrel continues to rotate with a uniform movement, for example in the direction of the arrow 65, the cavity 53 will no longer be supplied under pressure, the corresponding piston 64 having continued its stroke within its recess, the groove 60 having exceeded the orifice 54. On the other hand, the cavity 52 will reach the position of the cavity 61 and will be supplied with fluid under pressure, the cavity 61 having taken the place of the cavity 53.

Consequently, the stability of the resultant R′ is ensured, and improves as the number of pistons in the barrel 3 increases.

What is claimed is:

1. Hydraulic pump comprising:

a hollow support casing, a bearing block integral with said support casing, a slide face provided at one end of said casing and bearing two ports respectively for suction and discharge, a barrel mounted within said casing and capable of pivoting, on the one hand around an axis perpendicular to the surface of said slide face in said bearing block and, on the other hand, sliding against said slide face, said barrel comprising a plurality of hollow cylinders each having an opening leading to said slide face such that said openings pass over said ports when the barrel rotates, pistons sliding in a sealed manner respectively in said cylinders, means for controlling, when rotation is imparted to said barrel, on the one hand the movement of said pistons away from the opening of the cylinders in which they slide when this opening passes in front of the suction port and, on the other hand, the movement of said pistons toward the opening of said cylinders in which they slide when this opening passes in front of the discharge port, and means for sequentially applying fluid pressure developed during pump operation by supply of hydraulic fluid to said suction port and prevailing in said cylinders on a given portion between said bearing block and a drum part of said barrel engaging said bearing block, and wherein the means for sequentially applying fluid pressure prevailing in said cylinders on a given portion between the bearing block and said drum part engaging said bearing block comprises cavities associated respectively with each set of cylinders and pistons sliding in the cylinders, said cavities being defined between said bearing block and said barrel, the pistons being designed in the form of cylindrical pieces comprising hollow recesses having an opening towards the side of said barrel cooperating slidably with said slide face, a channel providing communication between each cavity and cylinder with which it is associated, a hole in the wall of each piston between said recess and the exterior, said hole being located such that when the piston moves in its cylinder, it passes opposite the location where said communication channel leads into said cylinder, and such that said channel is otherwise being constantly closed off by the wall of said piston.

2. The pump of claim 1 wherein at least a part of the barrel cooperating with said bearing block, in which said cavities are made, is constituted by a bushing of antifriction material.

3. The pump of claim 2 wherein said piston forming a cylinder has, on its exterior periphery, a circular groove of a given width made at the level of said hole.

4. The pump of claim 3, wherein during pump operation there is a pressure working phase and wherein said cavities communicate with each other through a throttle which, in operation, forms an oil film under pressure during the pressure working phase.

5. The pump of claim 4 wherein said bushing consists of a lining.

* * * * *